US010788239B2

(12) United States Patent
Brandt

(10) Patent No.: US 10,788,239 B2
(45) Date of Patent: Sep. 29, 2020

(54) GENERATOR SET LOUVER SYSTEM

(71) Applicant: MTU Onsite Energy Corporation, Mankato, MN (US)

(72) Inventor: Dylan James Brandt, Woden, IA (US)

(73) Assignee: MTU Onsite Energy Corporation, Mankato, MN (US)

( * ) Notice: Subject to any disclaimer, the term of this patent is extended or adjusted under 35 U.S.C. 154(b) by 0 days.

(21) Appl. No.: 16/257,990

(22) Filed: Jan. 25, 2019

(65) Prior Publication Data

US 2020/0240675 A1 Jul. 30, 2020

(51) Int. Cl.
*F24F 13/14* (2006.01)

(52) U.S. Cl.
CPC ..... *F24F 13/1426* (2013.01)

(58) Field of Classification Search
CPC ..... F24F 13/1426
See application file for complete search history.

(56) References Cited

U.S. PATENT DOCUMENTS

| | | | | |
|---|---|---|---|---|
| 2,652,245 | A | 9/1953 | Bentley | |
| 7,188,481 | B2 | 3/2007 | DeYoe et al. | |
| 8,150,603 | B2 * | 4/2012 | Willi | F02D 13/0211 123/435 |
| 2007/0256445 | A1 | 11/2007 | Grigoletto et al. | |
| 2008/0178526 | A1 * | 7/2008 | Browne | F24F 13/1426 49/82.1 |
| 2016/0049891 | A1 * | 2/2016 | Frampton | H02P 9/006 322/25 |

FOREIGN PATENT DOCUMENTS

| | | | | |
|---|---|---|---|---|
| CN | 105298355 A | * | 2/2016 | |
| WO | WO-2007102811 A1 | * | 9/2007 | F03G 1/02 |
| WO | WO-2015048549 A1 | * | 4/2015 | F02B 63/042 |

OTHER PUBLICATIONS

Caterpillar, Inc., "Application & Installation Guide—Engine Room Ventilation," LEBW49671-06, www.cat.com/power-systems, Applicant points out, in accordance with MPEP 609.04(a), that the year of publication, 2015, is sufficiently earlier than the effective U.S. filing date, so that the particular month of publication is not in issue, 36 pp.

Duro Dyne Corporation, "Duro Zone—Cable Operated Dampers," BEO35193, www.durodyne.com, first printed on May 2012, 52 pp.

AMCA International, "Introduction to Intake and Exhaust Louvers," An AMCA International White Paper, www.amca.org/whitepapers, Apr. 2016, 8 pp.

MTU Onsite Energy Corporation, "Installation and Basic Operation Manual," www.mtuonsiteenergy.com, Mar. 2015, 59 pp.

* cited by examiner

*Primary Examiner* — Jacob M Amick
*Assistant Examiner* — Charles Brauch
(74) *Attorney, Agent, or Firm* — Shumaker & Sieffert, P.A.

(57) ABSTRACT

The disclosure describes a generator set that includes a generator, an engine mechanically coupled to the generator, an enclosure housing the engine and the generator, a heating system, and a renewable energy-powered energy source. The generator is configured to supply power to an electrical system. The heating system is configured to heat at least one of the engine or the enclosure to at least a startup temperature. The renewable energy-powered energy source is configured to supply energy to the heating system to heat the at least one of the engine or the enclosure.

20 Claims, 3 Drawing Sheets

GENERATOR SET LOUVER SYSTEM

TECHNICAL FIELD

The disclosure relates to generator set enclosure ventilation.

BACKGROUND

A generator set enclosure protects a generator set from environmental elements, such as precipitation, temperature extremes, and foreign object damage. The generator set enclosure may include one or more openings to allow flow of air to and from the generator set. For example, a generator set enclosure may include an inlet opening to enable the generator set to draw supply air from an environment outside the generator set enclosure and an outlet opening to enable the generator set to discharge hot exhaust air to the environment outside the generator set enclosure.

SUMMARY

In some examples, the disclosure describes a system that includes a generator set enclosure, a gravity-operated louver, and an actuator. The generator set enclosure is configured to house the generator set. The gravity-operated louver is positioned in a wall of the generator set enclosure. The actuator is configured to exert an opening force on the louver in an operational state of the actuator. The louver is configured to open and close independent of the opening force from the actuator in a failed state of the actuator.

In other examples, the disclosure describes a method that includes receiving, by a controller, an operational indication from a generator set and sending, by the controller and in response to receiving the operational indication, a control signal to an actuator. The actuator is mechanically coupled to a gravity-operated louver through a mechanical link and configured to exert an opening force on the louver in an operational state of the actuator. The gravity-operated louver is positioned in a wall of the generator set enclosure and configured to open and close independent of the opening force from the actuator in a failed state of the actuator. The generator set enclosure is configured to house a generator set.

The details of one or more examples are set forth in the accompanying drawings and the description below. Other features, objects, and advantages of the disclosure will be apparent from the description and drawings, and from the claims.

DETAILED DESCRIPTION

In some examples, the disclosure describes louver systems configured for both gravity- and actuator-operation to discharge exhaust air from a generator set enclosure. Example louver systems include a gravity-operated louver positioned in a wall of the generator set enclosure and an actuator mechanically coupled to the louver through a mechanical link. The gravity-operated louver may be positioned in an intended intake or discharge path of supply or exhaust air to or from a generator set, such that received supply air to the generator set or discharged exhaust air from the generator set may at least partially overcome a gravitational force on the louver to open the louver. The actuator and mechanical link are configured to exert an opening force on the louver in a single direction. For example, the actuator may be a linear actuator and the mechanical link may be a slacked cable or chain that transmits a force from the actuator through tension, but not compression.

When the generator is not operating, the louver may remain shut due to the gravitational force on the louver. During operation of the generator, the actuator may apply a force, such as tension, compression, or torque, to the mechanical link to control an open position of the louver. For example, the actuator may open the louver to an extent greater than a louver only opened by a force of exhaust air from the generator set, as the force of exhaust air from the generator set may only partially open the louver. In the event of failure, the actuator may fail closed to create slack in the mechanical link. However, the louver may continue to open and close due to the force of the supply air to or exhaust air from the generator set.

In this way, the louver system may protect the generator set from elements when not operating, improve supply intake to and/or exhaust discharge from the generator set enclosure during actuator operation (e.g., improve a rate of discharge of exhaust air from the generator set enclosure) by reducing restrictions and/or pressure drop across the louvers, and continue to allow intake of supply air to or discharge of exhaust air from the generator set enclosure during actuator failure. As a result, example louver systems discussed herein may safely and efficiently intake supply air and/or discharge exhaust air from the generator set enclosure. For example, a generator set enclosure located in a hot climate may utilize louver systems discussed herein to operate with a higher cooling air throughput than louver systems solely operated by gravity, which may allow a generator set in the generator set enclosure to operate with correspondingly higher power ratings.

Figure 1A:
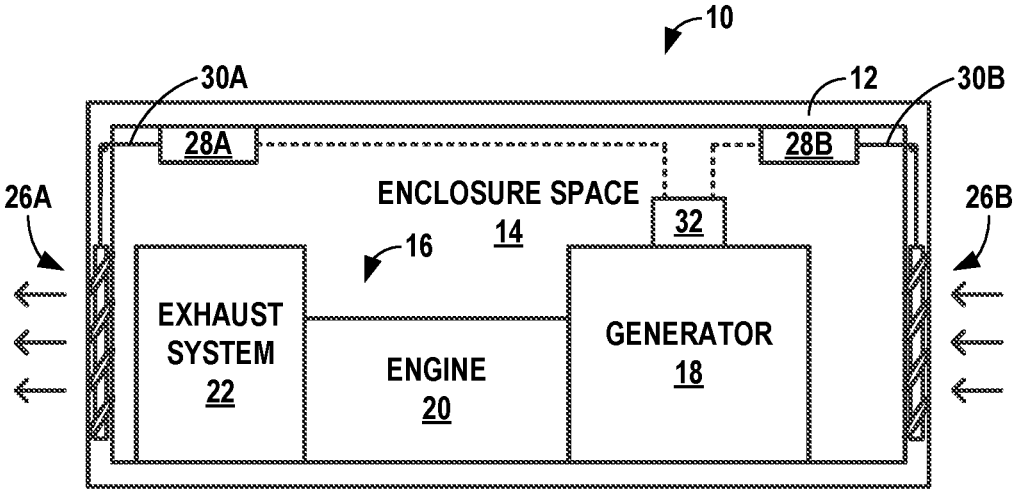
FIG. 1A is a conceptual diagram illustrating a side view of an example generator set enclosure.

FIG. 1A is a conceptual diagram illustrating a side view of system 10 that includes an example generator set enclosure and an exhaust louver system capable of both active operation from an actuator and passive operation from an exhaust system. While system 10 will be described with reference to a generator set enclosure, the principles of operation of system 10 may be used on a variety of systems in which a generator set is enclosed and requires adequate ventilation, such as an engine room.

System 10 includes a generator set enclosure 12 configured to house a generator set 16 in an enclosure space 14. In some examples, enclosure 12 may be configured to shelter components of system 10 from exposure to external conditions. For example, enclosure 12 may include equipment or systems that protect components of system 10 from rain, low temperatures, and the like. In some examples, enclosure 12 may be configured to provide a controlled environment around components of system 10. For example, enclosure 12 may provide enclosure space 14 around components of system 10 that may be controlled for ambient temperature, humidity, or other ambient conditions that may affect performance of an engine 20 and/or a generator 18 of a generator set 16. Generator set enclosures that may be used include, but are not limited to, drop-over enclosures, power module enclosures, engine rooms, and the like.

System 10 includes generator set 16. Generator set 16 may be configured to produce electrical power using a fuel source. Generator set 16 includes generator 18, engine 20, an exhaust system 22, and a controller 32. Generator set 16 may include other components not shown, such as a starter system, liquid cooling system, and other accessory systems.

Generator 18 may be mechanically coupled to engine 20, such as through a mechanical shaft or any other mechanical link configured to transfer mechanical energy from engine 20 to generator 18. Generator 18 may be configured to convert mechanical energy to electrical energy. Generator 18 may include any generator capable of converting the mechanical energy to electrical energy, such as an alternator. Generator 18 may be electrically coupled to an electrical distribution system (not shown in FIG. 1A) and configured to supply electrical power to the electrical distribution system. In some examples, the electrical distribution system may include one or more connections to an electrical grid, such that generator 18 may provide an alternative electrical power supply. In other examples, the electrical distribution system may be an islanded distribution system that may be isolated from any other electrical grid, such that generator 18 may be an on-demand power supply.

Engine 20 may be configured generate mechanical energy from a fuel source and transfer the mechanical energy to generator 18 for conversion into electrical power. Engine 20 may include any engine capable of generating mechanical energy from a fuel source, such as a diesel engine. Engine 20 may be fluidically coupled to the fuel source (not shown). For example, engine 20 may be fluidically coupled to a diesel fuel source, a gasoline fuel source, a biofuel fuel source, or any other fuel source that may provide fuel to engine 20.

Exhaust system 22 may be configured to discharge exhaust air from enclosure space 14. Exhaust system 22 may control flow of cooling air that removes radiant heat from components of generator set 16, such as engine 20 and generator 18, such as by controlling cooling or exhaust fans. For example, a temperature within enclosure space 14 may be limited to due to safety concerns, equipment temperature limits (e.g., reduced ratings for generator 18 above 40° C.), and the like. In some examples, exhaust system 22 may be part of a ventilation system for enclosure 12, such as a system that provides both combustion air for engine 20 and cooling air for generator set 16. In some examples, exhaust system 22 may be a stand-alone system for cooling engine 20 and/or generator 18, such as an engine-mounted radiator or remote radiator. Exhaust system 22 may include a variety of types of equipment configured to discharge air from enclosure space 14 including, but not limited to, engine-mounted exhaust fans, free-standing exhaust fans, wall-mounted exhaust fans, engine cooling fans (e.g., engine fans that draw air across components of engine 20 and/or generator 18 for cooling), and the like. In some examples, exhaust system 22 may include components configured to remove heat from components of generator set 16 to enclosure space 14 prior to discharge of the air from enclosure space 14, such as radiators or heat exchangers.

In some examples, exhaust system 22 may be positioned proximal to at least one of exhaust louver 26A or intake louver 26B (generically referred to as "louver 26" and collectively referred to as "louvers 26"), such as within five feet of one of louvers 26. Exhaust system 22 may be configured to exert an opening force one or both of louvers 26, as will be explained further in FIG. 2A below. For example, exhaust system 22 may be configured to supply a force of exhaust air (e.g., a flow rate of exhaust air, a pressure of exhaust air, etc.) that is sufficient to at least partially open one or both of louvers 26 upon failure of a respective one of exhaust actuator 28A or intake actuator 28B (generically referred to as "actuator 28" and collectively referred to as "actuators 28") such that generator set 16 may continue operation.

Controller 32 may be communicatively coupled to and configured to control components of system 10. For example, controller 32 may be configured to manage operation of components of system 10 based on operational inputs for system 10. Operational inputs of system 10 may include, but are not limited to: temperature setpoints, such as for ambient air of enclosure 12; pressure setpoints, such as for pressure ambient air of enclosure 12; startup sequence and timing of engine 20 and generator 18; and the like. While not shown, system 10 may include a variety of sensors, such as pressure sensors (e.g., pressure differential sensors for maintaining a positive or negative pressure in enclosure 12), temperature sensors, carbon monoxide sensors, and the like. Controller 32 may include any one or more of a wide range of devices, including processors (e.g., one or more microprocessors, one or more application specific integrated circuits (ASICs), one or more field programmable gate arrays (FPGAs), or the like), one or more servers, one or more desktop computers, one or more notebook (i.e., laptop) computers, one or more cloud computing clusters, or the like.

In some examples, controller 32 may be configured to control exhaust system 22. For example, controller 32 may be configured to receive an ambient temperature of enclosure space 14 from a temperature sensor, a pressure of enclosure space 14 from a pressure sensor, a power level from generator set 16, and other feedback related to cooling of components of generator set 16. Controller 32 may be configured to control exhaust system 22 to adequately cool components of generator set 16. For example, controller 32 may control a flow rate of exhaust system 22, such as a power of exhaust fans of exhaust system 22, to control the ambient temperature below a maximum temperature setpoint, a pressure above a minimum pressure setpoint, a flow rate of exhaust air above a flow rate setpoint, and the like, for a limit, rating, or power level of generator set 16. For example, generator set 16 or enclosure 12 may have absolute temperature limits or conditional (e.g., power level of generator set 16) flow rate schedules or ratings for various power levels.

In addition to exhaust system 22, system 10 includes structural components to enable air to be supplied to and discharged from enclosure space 14. For example, while shown in FIG. 1A as a gravity-operated louvers, in some examples, one of louvers 26 may be a fixed damper. For example, intake louver 26B may be configured as an intake damper to allow air into enclosure 12, such as combustion air for engine 20 or cooling air for generator set 16. Intake louver 26B may be fixed so that combustion and/or cooling air is continuously and safely provided to enclosure space 14. However, in other examples, unfixed (movable) dampers or louvers may be used.

System 10 includes at least one gravity-operated louver 26 positioned in a wall of generator set enclosure 12. Gravity-operated louver 26 may be configured to receive a closing force due to gravity. For example, as will be explained further in FIG. 1B below, gravity-operated louver 26 may be configured to translate a vertical or substantially vertical gravitational force into a closing force and translate a horizontal or substantially horizontal force of supply or exhaust air into an opening force. As such, in the absence of other forces on louver 26, louver 26 may operate (i.e., open and close) based on a change in a difference between a relatively constant gravitational force and a varying force from discharge of exhaust air from or intake of supply air to enclosure 12 by exhaust system 22.

Louver 26 may be designed for a variety of safety and operational conditions of enclosure 12 and/or generator set 16 including, but not limited to, a static restriction, a flow rate, a minimum operating position, an operating position schedule, and other conditions related to exhaust air discharge from and/or supply air intake to enclosure 12. In some examples, louver 26 may be configured to open less than about 75% at full exhaust from generator set 16 without an opening force from actuator 28. For example, louver 26 may be designed (e.g., by selecting weight, pivot position, etc.) to remain closed during strong winds. As a result of these design factors, louver 26 may only partially open from discharge of exhaust air or intake of supply air without an opening force from actuator 28. In some examples, louver 26 may be configured to open greater than about 25% at full exhaust from generator set 16 without an opening force from actuator 28. For example, louver 26 may be designed for a minimum amount of discharge air or discharge pressure from enclosure 12 that corresponds to, for example, 25% position. Exhaust fans from exhaust system 22 may experience a static pressure due to restriction caused by louver 26, so that more closed positions may create additional restrictions on the exhaust fans. As such, louver 26 may be designed such that louver 26 has a position greater than, for example, 25% so as to reduce a restriction on the exhaust fans while operating. A position of louver 26 may be represented by, for example, an angle of slats of louver 26 from a wall of enclosure 12, an open area of louver 26 as a percentage of total area, a static restriction pressure measurement of louver 26, or any other measure related to a state of louver 26 that correlates to a rate of discharge of exhaust air or intake of supply air for a particular force from exhaust air.

System 10 includes an actuator 28 mechanically coupled to each louver 26 through a respective mechanical link 30A or 30B (generically referred to as "mechanical link 30" and collectively referred to as "mechanical links 30"). When in an operational state, actuator 28 may be configured to exert an opening force on louver 26. When in a failed state, actuator 28 may not exert an opening force on louver 26, such that louver 26 may be configured to open and close independent of the opening force from the actuator in a failed state of the actuator. For example, each of actuators 28 is configured to open a respective louver 26 by exerting an opening force on louver 26 in a first direction and fail closed in a second direction, opposite the first direction. For example, actuator 28 may be configured to exert an opening force on louver 26 in the first direction that substantially opposes a gravitational force on louver 26. If actuator 28 fails to a failed state (i.e., loses power, loses a control signal, malfunctions, mechanically fails, etc.), actuator 28 may fail closed in a direction opposite the first direction of the opening force. For example, actuator 28 may include various components, such as solenoid valves, springs, pressure relief valves, and the like, that are configured to place actuator 28, upon failure, in a position that corresponds to a closed, or more closed, position of louver 26.

In some examples, actuator 28 includes a linear actuator. For example, a linear actuator may include a contracted piston position that corresponds to an open position of the linear actuator, and thus an open position of louver 26 or vice versa, an expanded piston position that corresponds to a closed position of the linear actuator, and thus a closed position of louver 26 or vice versa, and various gradations between the contracted and expanded piston positions that correspond to partially open positions of the linear actuator, and thus various partially open positions of louver 26. A spring or pressure bladder within a piston of the linear actuator may provide a closing force such that, if power is lost to the linear actuator, the piston fails to the closed position of the linear actuator, and thus the closed position of louver 26.

In some examples, actuator 28 includes an electromechanical actuator. For example, an electromechanical actuator may be powered by an electrical source and configured to translate electrical power into mechanical energy to operate louver 26. In some examples, the electromechanical actuator may be configured to receive electrical power from electrical energy produced by generator 18, such as direct current (DC) power. For example, once generator set 16 is producing electrical power, actuator 28 may receive a portion of the electrical power. In some examples, actuator 28 may be configured to automatically actuate in response to receiving electrical power from generator set 16. For example, to ensure intake of supply air and/or discharge of exhaust air while generator set 16 is operating, one or both of actuators 28 may be configured to automatically open louvers 28 upon start-up of generator set 16, with minimal or no control from controller 32. In this way, control of louvers 26 may be simplified compared to systems that use control logic to operate louvers.

In some examples, actuator 28 includes a hydraulic actuator. For example, a hydraulic actuator may be powered by a pressure source and configured to translate the pressure source into mechanical energy to operate louver 26. In some examples, the hydraulic actuator is coupled to a hydraulic circuit of generator set 16 and configured to receive hydraulic power (i.e., hydraulic fluid at pressure) from the hydraulic circuit. For example, once engine 20 has started up, actuator 28 may receive a portion of the hydraulic power. In some examples, actuator 28 may be configured to automatically actuate in response to receiving hydraulic power from generator set 16. For example, to ensure intake of supply air and/or discharge of exhaust air while generator set 16 is operating, one or both of actuators 28 may be configured to automatically open louvers 28 upon startup of engine 20, with minimal or no control from controller 32. In this way, control of louvers 26 may be simplified compared to systems that use control logic to operate louvers.

In some examples, mechanical link 30 is a slacked, or flexible, mechanical link configured to transmit an opening force from actuator 28 in the first direction through tension. For example, a solid mechanical link, such as a rod, may enable actuator 28 to transmit an opening force from actuator 28 in the first direction, but may continue to exert a closing force from actuator 28 in the second direction, opposite the first direction, through compression. As a result, such solid mechanical links may not enable louver 26 to continue to operate in the event of failure of actuator 28. By using a slacked or flexible mechanical link for mechanical link 30, system 10 may allow gravity-operated louver 26 to continue to operate in response to gravitational forces and/or forces from exhaust air or supply air in the event of actuator 28 failing open in the second direction (and the louvers failing closed but still responsive to gravity and air pressure). In some examples, mechanical link 30 includes at least one of a wire, string, ribbon, belt, cable, a chain, or the like.

In some examples, actuator 28 is positioned away from louver 26. For example, exhaust system 22 may be located close to louver 26A, such that exhaust air discharged from exhaust system 22 may discharge more directly through louver 26A and/or create a greater force on louver 26A. However, such close placement limit access to components near louver 26A may interfere with access to louver 26A for servicing. To enable easier access to actuator 28 for servicing and/or remove actuator 28 from interfering with passage through enclosure 12, actuator 28 may be located away from louver 26. In some examples, actuator 28 may be positioned greater than about one foot from louver 26. For example, louver 26 may be positioned between about one foot and about five feet from the floor of enclosure 12, such that placement of actuator 28 greater than about one foot from louver 26 may remove actuator 28 from interfering with working space within enclosure space 14, reduce an exposure of actuator 28 to heated exhaust air, allow closer placement of exhaust system 22 to louver 26 while maintaining access to louver 26 for servicing, and/or allow a lower profile for louver 26. In some examples, actuator 28 may be positioned on at least one of a ceiling or a wall of generator set enclosure 12. For example, an upper volume of enclosure space 14 that may not be used for components of generator set 16 may be used to house actuator 28, thereby more efficiently utilizing enclosure space 14, allowing electronics (e.g., controller 34 and/or actuator 28) of system 10 to be in enclosure 12, and/or allowing easier access to actuator 28, such as for maintenance.

In some examples, controller 32 may be communicatively coupled to actuator 28 and generator set 16. For example, controller 32 may be configured to receive an operational indication from generator set 16 and send, in response to receiving the operational indication, a control signal to actuator 28. For example, the operational indication may include at least one of a start-up of the generator set or exceeding a power threshold of the generator set. In some examples, controller 32 may send a control signal to actuator 28 prior to start-up of generator set 16. For example, controller 32 may be configured to send a control signal to actuator 28 as part of a start-up sequence. In other examples, controller 32 may send a control signal to actuator 28 after start-up of generator set 16. For example, actuator 28 may be configured to receive power from generator 18 once generator 18 is producing power. Further operation of controller 32 will be described in FIG. 3 below. In some examples, as explained above, actuators 28 may automatically actuate upon receiving power from generator set 16, such as electrical power or hydraulic power, such that controller 32 may not control actuators 28.

Figure 1B:
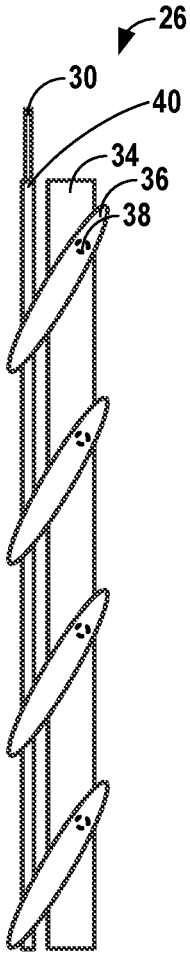
FIG. 1B is a conceptual diagram illustrating a side view of an example louver system for discharging exhaust from a generator set enclosure.
Figure 1C:
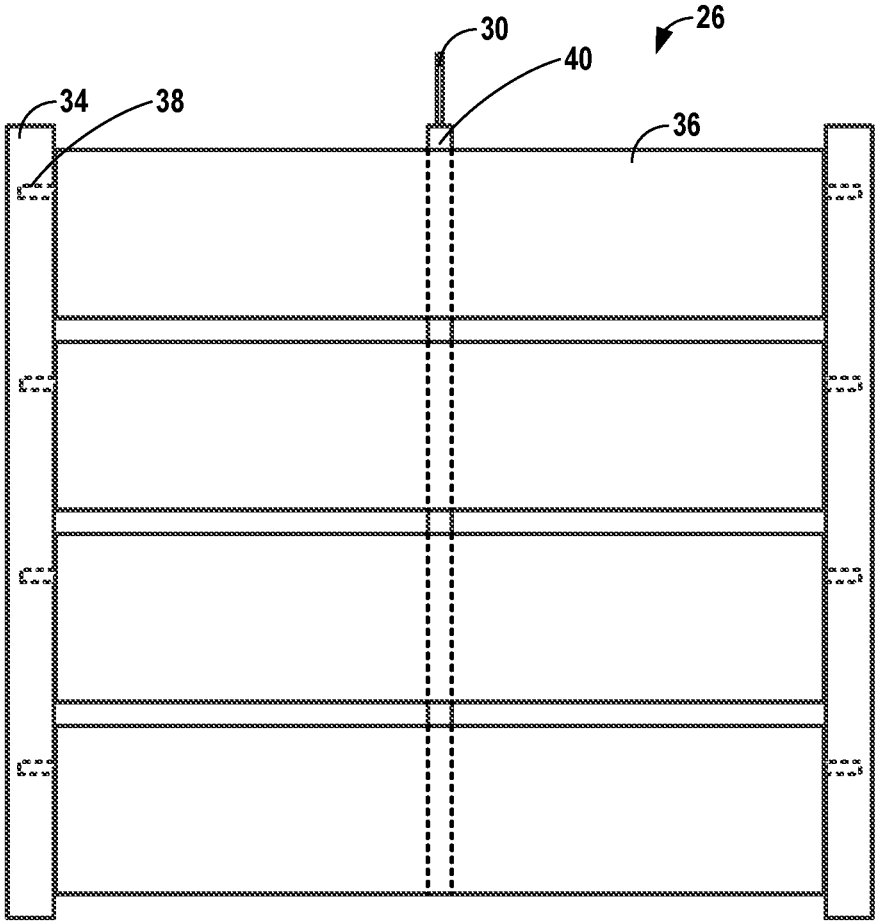
FIG. 1C is a conceptual diagram illustrating a front view of an example louver system for discharging exhaust from a generator set enclosure.

FIG. 1B is a conceptual diagram illustrating a side view of louver 26 for discharging exhaust air from or receiving supply air to generator set enclosure 12, while FIG. 1C is a conceptual diagram illustrating a front view of louver 26 for discharging exhaust from or receiving supply air to generator set enclosure 12.

Louver 26 includes a plurality of moveable slats 36. The plurality of moveable slats 36 may be configured to receive an opening force from either of actuator 28 or an exhaust from or supply to generator set 16, such as exhaust system 22. For example, while actuator 28 is in an operational state and generator set 16 is in an operational state, both actuator 28 and exhaust from or supply to generator set 16 may exert opening forces on louver 26. The plurality of moveable slats 36 may also be configured to receive a closing force from gravity. For example, while actuator 28 is in a failed state and generator set 16 is in an operation state, exhaust from or supply to generator 16 may exert an opening force on louver 26 and gravity may exert a closing force on louver 26. As such, the plurality of moveable slats 36 may be configured to open and close based on a change in opening and closing forces on the plurality of moveable slats 36 due to gravity, exhaust/supply flow, and/or actuator 28.

Louver 26 includes a frame 34. In some examples, frame 34 is part of a wall of enclosure 12, while in other examples, frame 34 is a stand-alone structure fitted into a wall of enclosure 12. Each moveable slat of the plurality of moveable slats 36 includes one or more pivots 38 for enabling each respective moveable slat to move relative to frame 34. In the example of FIG. 1B, each pivot 38 may include an extension that fits into a pocket or other recess of frame 34; however, in other examples, other mechanisms and configurations may be used. Each pivot 38 may be positioned relative to a center of mass such that the respective moveable slat may open in response to a horizontal exhaust air force and close in response to a vertical gravitational force, as will be explained further in FIGS. 2A-2C below.

The plurality of moveable slats 36 may be configured to operate across a range of louver positions. In some examples, each slat of the plurality of moveable slats 36 is configured to be fully open at an angle greater than about 80 degrees from the wall of generator set enclosure 12 and fully closed at an angle less than about 10 degrees from the wall of generator set enclosure 12, and positioned at an intermediate angle in response to the balance of opening and closing forces described above.

Louver 26 includes an operating member 40 coupled to the plurality of moveable slats 36 and mechanical link 30. Operating member 40 may be configured to exert the opening force from actuator 28 on the plurality of moveable slats 36. For example, operating member 40 may be configured to rotate the plurality of moveable slats 36 around the respective pivots 38 to open louver 26. While operating member 40 is illustrated as a rod, in other examples, operating member 40 may include any mechanical mechanism that is capable of rotating the plurality of slats 36 to open louver 26 in response to an opening force exerted on operating member 40 by mechanical link 30.

Figure 2A:
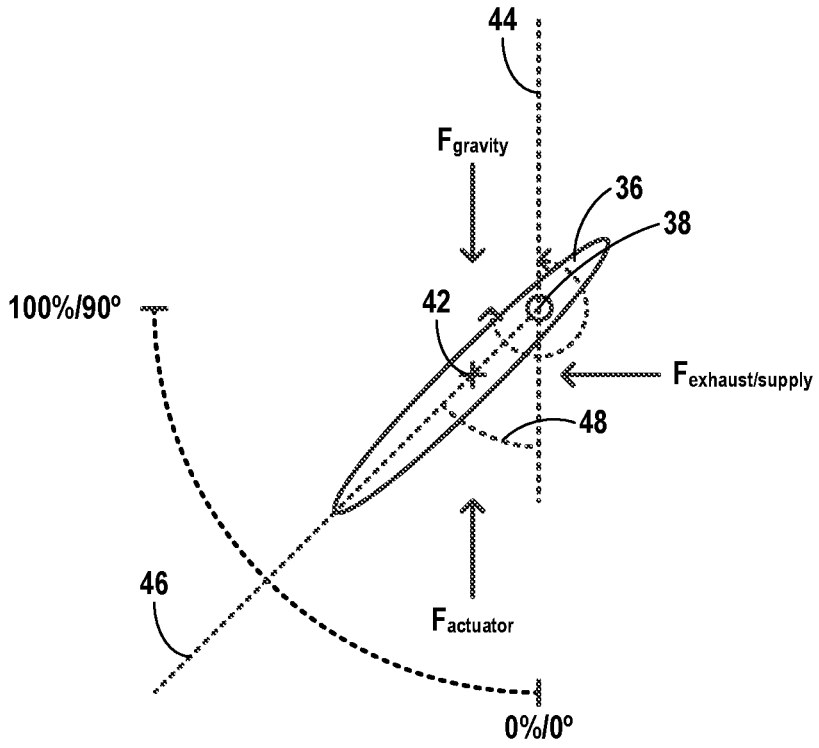
FIG. 2A is a conceptual diagram illustrating a side view of an example slat of a louver system and various forces acting on the slat.

As explained above, louver systems described herein may operate using opening forces provided by an actuator and an exhaust/supply flow and closing forces provided by gravity. FIG. 2A is a conceptual diagram illustrating a side view of an example slat 36 of a louver system and various forces acting on the slat. For example, the louver system may include louver 26, actuator 28, and mechanical link 30 of FIGS. 1A-C. Slat 36 includes a center of mass 42 and is configured to rotate around pivot 38 in response to a change in a difference of opening and closing forces. Slat 36 may be configured to open through a range of louver positions from 0% (i.e., substantially closed) to 100% (i.e., substantially open).

Each slat 26 experiences a closing force from gravity (Fgravity). For example, the closing force from gravity may exert a downward force on center of mass 42, causing slat 36 to rotate around pivot 38 counter-clockwise from the perspective of FIG. 2A. This gravitational force may be dependent on a variety of factors including, but not limited to, a weight of slat 36 or other components coupled to slat 36, a position of pivot 38, and the like. As slat 36 rotates around pivot 38, slat 36 may change a position of slat 36. In the example of FIG. 2A, a position of slat 36 is represented as an angle 48 of slat 36 between a plane 46 of slat 36 and a plane 44 of a wall of frame 34, enclosure 12, or any other structure in which louver 26 is positioned. However, in other examples, a position of slat 36 may be represented by another measure of a degree of openness of slat 36 within louver 26. As slat 36 rotates around pivot 38 to increase an open position of slat 36 (e.g., increase angle 48), a distance between center of mass 42 and pivot 38 may increase, thereby increasing the gravitational force on slat 36.

Each slat 26 may be configured to receive an opening force from an actuator 28 ($F_{actuator}$). This opening force may be in a direction substantially opposite the direction of the gravitational force. For example, the opening force from the actuator 28 may exert an upward force on center of mass 42, causing slat 36 to rotate around pivot 38 clockwise from the perspective of FIG. 2A. The opening force from actuator 28 may correspond to a desired position of louver 26. For example, actuator 28 may be a liner actuator that exerts an amount of force required to move actuator 28 to a predetermined position that corresponds to the desired position of slat 36.

Each slat 36 may be configured to receive an opening force from exhaust or supply air $F_{exhaust/supply}$ from or to a generator set. The opening force from exhaust or supply air may correspond to a flow rate of exhaust air from exhaust system 22 out of or into enclosure 12. For example, as a power level of generator set 16 increases or an ambient temperature of enclosure 12 increases, controller 32 may control exhaust system 22 to increase a flow rate of exhaust air from enclosure 12.

Figure 2B:
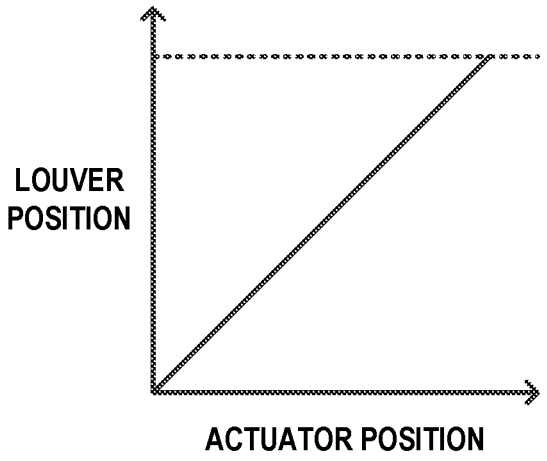
FIG. 2B is an example graph illustrating a louver position versus a position of a linear actuator.

FIG. 2B is an example graph illustrating a louver position versus a position of a linear actuator as actuator 28. In the example of FIG. 2B, exhaust system 22 is not providing any opening force on slat 36 due to exhaust/supply flow, such that a louver position is linearly proportional to an actuator position through a range of the louver positions. During an operational state of actuator 28, at least a portion of a range of the louver position may be controlled by actuator 28, such that louver 26 may operate with less restriction than a louver that is not operated by an actuator.

Figure 2C:
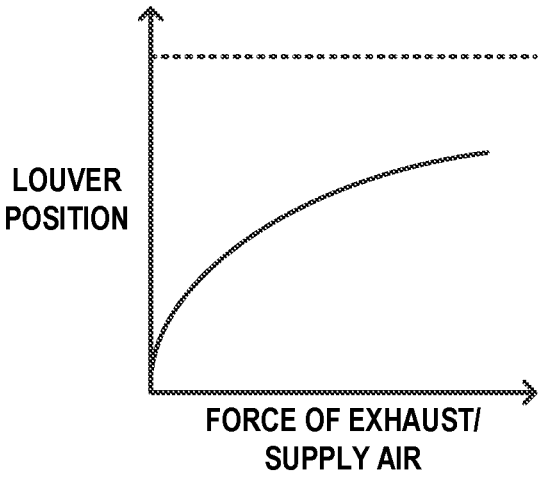
FIG. 2C is an example graph illustrating a louver position versus a force of exhaust air.

FIG. 2C is an example graph illustrating a louver position versus a force of exhaust/supply air from exhaust system 22. In the example of FIG. 2C, actuator 28 is not providing any operating force, such that a force of exhaust air from exhaust system 22 on louver 26 is equal to a gravitational force on louver 26. As shown in FIG. 2B, as louver position increases, a greater amount of force of exhaust air is required to open the louver due to a greater amount of gravitational force from a change in position of center of mass 42 of slat 36 relative to pivot 38. As such, a range of louver positions may be restricted.

During an operational state of the linear actuator, at least a range of the louver position (opening and closing) may be controlled using the linear actuator. For example, if a low louver position (e.g., less than about 25% open) is desired, a force of exhaust air from an exhaust system may be capable of achieving the low louver position, as shown in FIG. 2C, such that the linear actuator may not be operated. However, if a high louver position (e.g., greater than about 50% open) is desired, a force of exhaust air from exhaust system 22 may not be capable of achieving the high louver position due to the higher amount of force required to counteract gravity. As such, actuator 28 may be operated such that a position of actuator 28 corresponds to the high louver position. As a result, a higher louver position may be achieved than with a louver that is solely gravity and exhaust flow operated. Such higher louver position may reduce a restriction to a cooling or exhaust fan by mechanically holding the louvers open, enabling exhaust system 22 to discharge a higher rate of exhaust or supply air than a louver system with a lower maximum louver position, thereby increasing airflow for better cooling package performance.

Upon failure of actuator 28 to a failed state, actuator 28 may fail closed, such the louver fails closed but slats 36 are free to move under the force of the exhaust or supply air from exhaust system 22 and gravity without assistance from the linear actuator, as shown in FIG. 2C. While the range of louver position may be reduced compared to operation using the linear actuator, louver 26 may continue to operate, such that generator set 16 may maintain continuity of operation even in the event that actuator 28 fails.

While the louver systems have been described with respect to FIGS. 1A-1C and FIGS. 2A-2C, other joint gravity- and actuator-operated louver systems operating within the principles of the disclosure may be used. For example, a rotary actuator may be used instead of a linear actuator, such that the actuator position with respect to louver position may not be linear, as shown in FIG. 2B.

Figure 3:
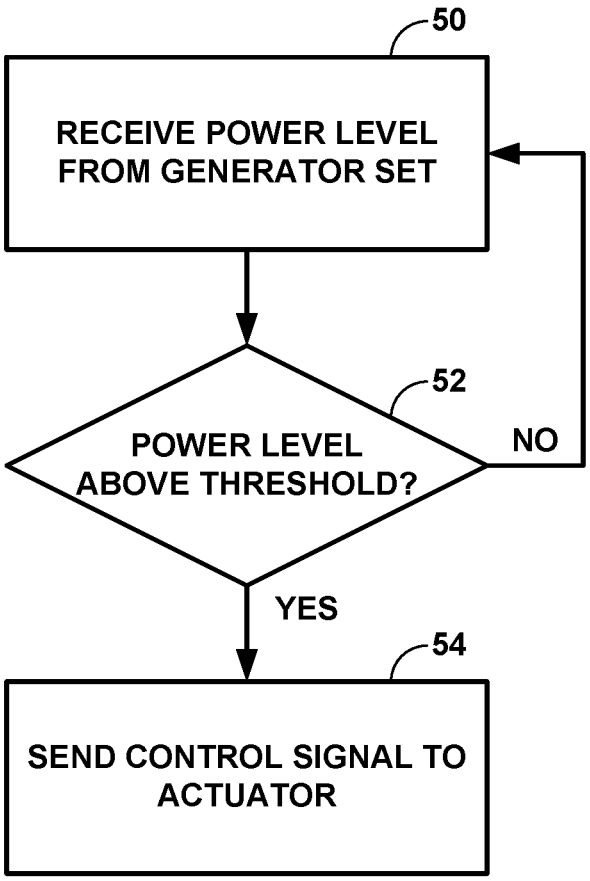
FIG. 3 is a flow diagram illustrating an example technique for operating an example louver system for discharging exhaust from a generator set enclosure.

In some examples, louver systems discussed herein may have be capable of selecting active and passive operation based on operating conditions of generator set 16. FIG. 3 is a flow diagram illustrating an example technique for operating an example louver system for discharging exhaust from a generator set enclosure based on a power level of the generator set. The example technique of FIG. 3 will be described with respect to system 10 of FIGS. 1A-1C. However, the techniques of FIG. 3 may be used with other systems and components. Additionally, the techniques of FIG. 3 are described with respect to a power level of generator set 16, but other variables related to cooling air, such as ambient temperature within enclosure 12 or pressure within enclosure 12, and their corresponding setpoints, may be used as control variables for switching between active and passive operation of louver systems.

Controller 32 may receive a power level from generator set 16 (50). For example, controller 32 may receive a shaft speed of engine 20 corresponding to a power level of generator set 16. As another example, controller 32 may receive the power level from generator set 16 by determining the power level of generator set 16, such as from a control signal selected by an operator of generator set 16.

Controller 32 may evaluate whether the power level is above a threshold (52). In some examples, the power level may be a power level indicating a start-up of generator set 16. For example, controller 32 may be configured to control one or both of actuators 28 to at least partially open when generator set 16 is operating. In some examples, controller 32 may be configured to operate actuator 28 such that louver 26 is fully open when generator set 16 is operating. In some examples, the power level may be a power level that corresponds to increased cooling from exhaust system 22. For example, as explained previously with respect to FIGS. 2B and 2C, for low power levels, system 10 may be capable of adequately discharging exhaust air using only gravity-operation of louver 26. As such, the threshold may correspond to a power level at which controller 32 may begin actuator-operation of louver 26. Alternatively, rather than using a power level, controller 32 may use another threshold, such as a temperature threshold or pressure threshold, for a different operational indication.

Controller 32 may send, in response to determining that the power level exceeds the threshold, a control signal to actuator 28 (54). In some examples, the control signal is directly proportional to a power level of generator set 16.

The techniques described in this disclosure may be implemented, at least in part, in hardware, software, firmware, or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit including hardware may also perform one or more of the techniques of this disclosure.

Such hardware, software, and firmware may be implemented within the same device or within separate devices to support the various techniques described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware, firmware, or software components. Rather, functionality associated with one or more modules or units may be performed by separate hardware, firmware, or software components, or integrated within common or separate hardware, firmware, or software components.

The techniques described in this disclosure may also be embodied or encoded in an article of manufacture including a computer-readable storage medium encoded with instructions. Instructions embedded or encoded in an article of manufacture including a computer-readable storage medium, may cause one or more programmable processors, or other processors, to implement one or more of the techniques described herein, such as when instructions included or encoded in the computer-readable storage medium are executed by the one or more processors. Computer readable storage media may include random access memory (RAM), read only memory (ROM), programmable read only memory (PROM), erasable programmable read only memory (EPROM), electronically erasable programmable read only memory (EEPROM), flash memory, a hard disk, a compact disc ROM (CD-ROM), a floppy disk, a cassette, magnetic media, optical media, or other computer readable media. In some examples, an article of manufacture may include one or more computer-readable storage media.

In some examples, a computer-readable storage medium may include a non-transitory medium. The term "non-transitory" may indicate that the storage medium is not embodied in a carrier wave or a propagated signal. In certain examples, a non-transitory storage medium may store data that can, over time, change (e.g., in RAM or cache).

Various examples have been described. These and other examples are within the scope of the following claims.

What is claimed is:

1. A system, comprising:

a generator set enclosure configured to house a generator set;

a gravity-operated louver positioned in a wall of the generator set enclosure;

an actuator mechanically coupled to the louver through a mechanical link, wherein the actuator is configured to, in an operational state of the actuator, exert an opening force on the louver, and wherein the louver is configured to, in a failed state of the actuator, open and close only in response to an opening force from exhaust air from or supply air to the generator set and a closing force from gravity.

2. The system of claim 1, wherein the louver further comprises:

a plurality of moveable slats configured to:

receive at least one of the opening force from the actuator or the opening force from exhaust air from or supply air to the generator set; and receive the closing force from gravity; and an operating member coupled to the plurality of moveable slats and the mechanical link and configured to, in the operational state of the actuator, exert the opening force from the actuator on the plurality of moveable slats.

3. The system of claim 1, wherein the mechanical link is a slacked mechanical link configured to, in the operational state of the actuator, transmit the opening force from the actuator in the first direction through tension.

4. The system of claim 1, wherein the actuator is configured to, in the operational state of the actuator, exert the opening force on the louver in a first direction and fail closed in a second direction, opposite the first direction.

5. The system of claim 1, wherein the actuator is positioned on at least one of a ceiling or a wall of the generator set enclosure.

6. The system of claim 1, wherein the louver is configured to open less than about 75% at full exhaust from the generator set without an opening force from the actuator.

7. The system of claim 1, wherein the louver is configured to open greater than about 25% at full exhaust from the generator set without an opening force from the actuator.

8. The system of claim 1, further comprising a controller communicatively coupled to the actuator and the generator set and configured to:

receive an operational indication from the generator set; and send, in response to receiving the operational indication and in the operational state of the actuator, a control signal to the actuator.

9. The system of claim 8, wherein the operational indication comprises at least one of an indication of a start-up of the generator set or an indication of the generator set exceeding a power threshold.

10. The system of claim 1, wherein the actuator is powered by the generator set.

11. The system of claim 10, wherein the actuator is an electromechanical actuator configured to receive electrical power from the generator set.

12. The system of claim 10, wherein the actuator is a hydraulic actuator configured to receive hydraulic power from the generator set.

13. The system of claim 2, wherein each slat of the plurality of moveable slats is configured to be fully open at an angle greater than about 80 degrees from the wall of the generator set and fully closed at an angle less than about 10 degrees from the wall of the generator set.

14. The system of claim 1, wherein the generator set further comprises an exhaust system positioned proximate to the louver and configured to exert an opening force from exhaust air on the louver.

15. The system of claim 1, wherein the actuator is an exhaust actuator, and wherein the louver is an exhaust louver configured to receive an opening force from exhaust air from the generator set.

16. The system of claim 15, further comprising:

a gravity-operated intake louver positioned in the wall of the generator set enclosure;

an intake actuator mechanically coupled to the intake louver through an intake mechanical link, wherein the intake actuator is configured to, in an operational state of the intake actuator, exert an opening force on the intake louver, and wherein the intake louver is configured to, in a failed state of the intake actuator, open and close only in response to an opening force from supply air to the generator set and a closing force from gravity.

17. A method, comprising:

receiving, by a controller, an operational indication from a generator set; and sending, by the controller and in response to receiving the operational indication, a control signal to an actuator to operate the actuator, wherein the actuator is mechanically coupled to a gravity-operated louver through a mechanical link and configured to, in an operational state of the actuator, exert an opening force on the louver, wherein the gravity-operated louver is positioned in a wall of the generator set enclosure and configured to, in a failed state of the actuator, open and close only in response to an opening force from exhaust air from or supply air to the generator set and a closing force from gravity, and wherein the generator set enclosure is configured to house the generator set.

18. The method of claim 17, wherein the operational indication comprises at least one of an indication of a start-up of the generator set or an indication of the generator set exceeding a power threshold.

19. The method of claim 17, wherein the operational indication comprises an indication of a power level of the generator set, and further comprising:

evaluating, by the controller, whether the power level is above a power threshold of the generator set, wherein the power threshold corresponds to the power level at which to shift from gravity-operation of the louver to actuator-operation of the louver; and sending, by the controller and in response to determining that the power level is above the power level threshold of the generator set, a control signal to the actuator to open the louver.

20. The method of claim 19, wherein the control signal is directly proportional to the power level of the generator set.

* * * * *